United States Patent [19]

Nagata

[11] 3,968,986

[45] July 13, 1976

[54] ELECTROMAGNETIC LIFTING DEVICE

[75] Inventor: Toshio Nagata, Tokyo, Japan

[73] Assignee: Kohan Sendan Kikai Kabushikikaisha, Japan

[22] Filed: July 25, 1975

[21] Appl. No.: 599,150

[30] Foreign Application Priority Data

Aug. 8, 1974 Japan ..... 49-94079[U]
Oct. 7, 1974 Japan ..... 49-120268[U]

[52] U.S. Cl. ..... 294/65.5; 294/81 R; 335/289

[51] Int. Cl.[2] ..... B66C 1/06

[58] Field of Search ..... 294/65, 65.5, 67 R, 294/74, 81 R, 86 R; 254/135 CE; 335/285, 286, 287, 289, 291

[56] References Cited

UNITED STATES PATENTS

| | | | |
|---|---|---|---|
| 621,267 | 3/1899 | Monell | 294/65.5 |
| 3,363,209 | 1/1968 | Pevar | 335/286 |
| 3,486,784 | 12/1969 | Ejlertsen | 294/65.5 |
| 3,773,185 | 11/1973 | Johnson et al. | 294/65.5 X |

FOREIGN PATENTS OR APPLICATIONS

| | | | |
|---|---|---|---|
| 486,001 | 3/1918 | France | 294/65.5 |
| 192,645 | 8/1906 | Germany | 294/65.5 |

*Primary Examiner*—John J. Love
*Assistant Examiner*—Johnny D. Cherry
*Attorney, Agent, or Firm*—Kane, Dalsimer, Kane, Sullivan and Kurucz

[57] ABSTRACT

An electromagnetic lifting device for handling a ferromagnetic material, which device has a magnetic assembly consisting of a plurality of movable magnetic pole members having relatively small pole areas, and said assembly has a given total pole area, thus said total area being the sum of the pole areas of the movable magnetic pole members. In this electromagnetic lifting device, the respective magnetic pole members to be excited electrically are assembled in a manner to permit same to move vertically relative to each other, so that the magnetic pole members can accommodate themselves to the configuration, such as concave, convex or curved surface of a ferromagnetic material and move in vertical direction so as to freely contact the surface of the ferromagnetic material, thereby exerting an effective lifting force on the ferromagnetic material.

11 Claims, 7 Drawing Figures

ELECTROMAGNETIC LIFTING DEVICE

BACKGROUND OF THE INVENTION

This invention relates to an electromagnetic lifting device for handling a ferromagnetic material, and more particularly to the device of the type described, which is adapted for use in safely handling the ferromagnetic material having a curved surface or irregular surface, or the ferromagnetic material susceptible to deflection.

In using an electromagnet for lifting a worked or unworked ferromagnetic material having a concave or convex surface, it is imperative that the contacting area between the attracting surface of the electromagnet and the surface of the ferromagnetic material to be lifted be increased so as to exert an effective magnetic force on the material.

Hitherto, it has been a common practice to use a large size electromagnet, as compared with the size of a ferromagnetic material to be lifted, in handling the material like a steel product having a curved surface or the material like a metal sheet or plate having a wide width and susceptible to deflection, in the field of steel-stock working industries, such as iron works and ship-building yard. More particularly, the conventional electromagnetic lifting device suffers from disadvantages in that there may not be achieved a sufficient contacting area between the flat surface of a single magnetic pole of an electromagnet and the curved surface of the steel product, and that there may not be maintained a sufficient contacting area between the flat pole surface and the metal sheet or plate due to the deflection of the cantilever portion of the sheet or plate. This brings about a danger of the material dropping off the magnet when handling same, thereby necessitating the use of a large size electromagnet.

For avoiding said shortcomings, there have been proposed attempts such as disclosed in the Japanese Utility Model Public Disclosure No. 80052/1973 and the Japanese Utility Model Publication No. 16363/1972. According to these proposals, there are provided magnetic poles which are accommodated to the curved surface of a steel product by providing a deformable bag containing ferromagnetic powder therein or a flexible ferromagnetic material which is secured to an electromagnet, in an attempt to increase the contacting area between the magnetic pole and the steel product. However, those attempts pose problems such as poor durability and a reduced magnetic force.

SUMMARY OF THE INVENTION

It is accordingly a principal object of the present invention to provide an electromagnetic lifting device for use in handling a ferromagnetic material, which device permits the safe handling of said material by exerting a positive and effective magnetic force thereon, despite the configuration or the deflection of the ferromagnetic device.

For achieving said object and features of the electromagnetic lifting device according to the present invention, there is provided an electromagnetic lifting device, in which a magnetic pole assembly having a given pole area consists of a plurality of magnetic pole members each having relatively small area. Stated otherwise, a magnetic pole assembly having a given pole area is divided into a plurality of magnetic pole members which are movable relative to each other.

The electromagnetic lifting device according to the present invention is characterized in that an electromagnet consists of a plurality of magnetic pole members which are assembled in a manner to permit the relative vertical movement and adapted to be excited electrically, so that the respective magnetic pole members may move relative to each other in the vertical direction, accommodating the configurations or the deflection of a ferromagnetic material. In addition, the magnetic pole surfaces of the respective magnetic pole members freely contact the surface of a ferromagnetic material to be lifted, thereby insuring the sufficient contacting area between magnetic pole members and said material, so that a magnetic lifting force is effectively applied to the material with the resulting improved safety in handling or lifting the same.

BRIEF DESCRIPTION OF THE DRAWINGS

These and other features of the present invention will be apparent from a reading of the ensuing part of the specification in conjunction with the accompanying drawings which show preferred embodiments of the invention, in which.

DESCRIPTION OF THE PREFERRED EMBODIMENTS

Figure 1:
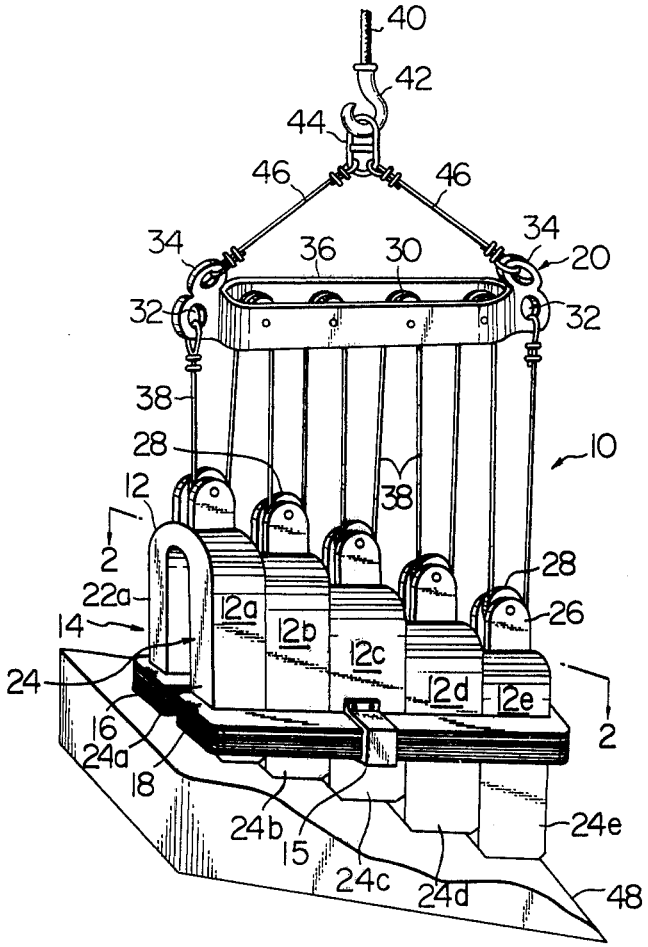
FIG. 1 is a perspective view of the electromagnetic lifting device according to the present invention, with a steel product attracted to a plurality of magnetic pole members.

Referring now to FIG. 1, generally shown at 10 is an electromagnetic lifting device for use in handling a ferromagnetic material. Meant by the term "ferromagnetic material" as used herein is ferromagnetic metal products of all forms, including a sheet, plate, tube, pipe, coil, etc., irrespective of whether it is produced by casting, forging, machining, sheet-metal working, etc.

The device 10 includes a magnetic pole assembly 14 composed of a plurality of magnetic pole members 12 (12*a* to 12*e*), first and second magnet-exciting electrical coils 16, 18 which are each secured by a band 15 to one of the magnetic pole members, for instance, to the central member 12*c* as shown, and connecting means adapted to connect the magnetic pole members 12 in a relatively movable manner.

The magnetic pole members 12 are made of a ferromagnetic metal, each being formed with a pair of yokes 22 (22*a* to 22*e*) and 24 (24*a* to 24*e*), each pair of which face each other, while the yokes are of a U-shape. As shown, the U-shaped magnetic pole members each have yokes whose free ends are directed downwards and the yokes have sheave frames in their top portions.

The yokes 22 and 24 of the magnetic pole members are so arranged that they are placed in side by side relation, while permitting the relative movement therebetween, i.e., the yokes may move vertically or up and down, as viewed in FIG. 1, by means of the connecting means 20.

Figure 2:
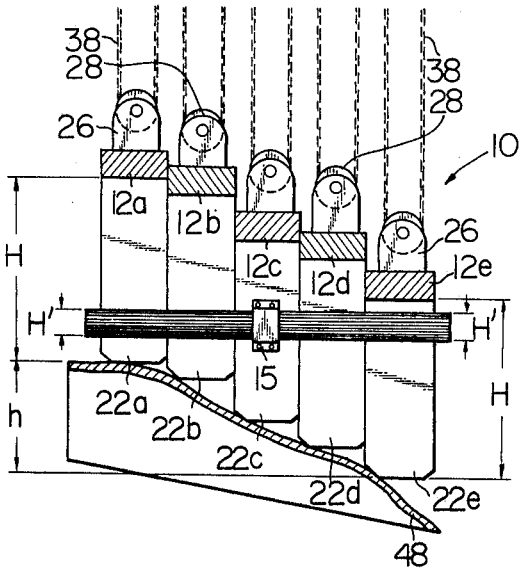
FIG. 2 is a partial cross sectional view taken along the line 2—2 of FIG. 1.

The extents of the relative movements of the yokes 22, 24, i.e., the allowable extent of the vertical movements thereof depend on the length H (FIG. 2). In this instance as shown, the extent of the relative movements of the yokes is equal to the length H of the yokes less the height H′ of the electrical coils 16, 18 (FIG. 2).

When the electrical coils 16, 18 are energized, then the yokes 22, 24 are excited so that the ends of the magnetic pole members on one side exhibit one magnetic pole, for instance, N-pole, while the ends of the magnetic pole members on the other side exhibit the other magnetic pole, i.e., S-pole.

The connecting means 20 includes: pulleys 28 journalled in the sheave frame 26 on the top portions of the respective magnetic pole members 12; a beam 36 located above the pulleys 28, i.e., above the magnetic pole assembly 14 and having a plurality of pulleys journaled therein and rings 32 and suspension lugs 34 on the opposite sides thereof; a single run of rope 38 which is trained around the pulleys journaled in the beam 36 as well as around the pulleys 28 provided in the magnetic pole members 12, said rope being fastened at its both extremities to the rings 32 of the beam 36; a suspension ring 44 located above the beam 36 and adapted to admit therein a hook 42 connected to a suspension wire 40; and a supporting rope 46 fastened at one end thereof to the suspension ring 44 and at the other end to the suspension lug 34; so that the pulleys 28, 30 and rope 38 permit a wide range of the relative movement of the magnetic pole members 12 of the magnetic pole assembly 14.

When a steel product 48 having a surface presenting a large extent of irregularity is lifted by using the device 10, the device 10 is located above the steel product, prior to energizing the electric coils 16, 18 of the lifting means 10. Then, a take-up means (not shown) for the suspension wire 40 is operated to release the tension on the suspension wire, thereby permitting the beam to go down. The downward movement of the beam 36 lowers the magnetic pole assembly 14 in its entirety. When the beam 36 is further lowered, then the yoke 22, 24 of the magnetic pole members 12 will first contact the steel product 48, which yokes have been located nearest to the steel product. In other words, in FIG. 2, the yoke 22a of the magnetic pole member 12*a* first contacts the steel product 48.

Subsequently, the yokes 22*b*, 22*c*, 22*d*, 22*e* of the magnetic pole members 12*b*, 12*c*, 12*d*, 12*e* in turn contact the surface of the steel product 48. The contact between the magnetic pole members 12 and steel product 48 may be positively achieved within the range of the difference *h* in height, which is close to the wide extent H′—H′ of the relative movements of the magnetic pole members 12. (FIG. 2)

After the ends of the magnetic pole members are then all brought into contact with the surface of the steel stock 48, a current is fed to the electric coils 16, 18. The current being fed to the electric coils 16, 18 turns the ends of the yokes 22, 24 into a composite magnetic pole, so that the steel product may be attracted to the magnetic pole members at a plurality of points. Then, with a current fed to the electric coils 16, 18, the suspension wire 40 is wound. The winding of the suspension wire 40 causes a tension on the ropes 46 and 38. In addition, when the suspension wire 40 is further wound, then the device 10 is lifted, with the steel stock attracted thereto. Since the magnetic pole members 12 have the steel product 48 attracted to the ends thereof, when the steel product 48 is being lifted, the relative movements of the respective members 12 are prevented. Accordingly the device 10 may suspend the steel stock, with many contacting points given between the irregular or spherical surface of a stock and the end surfaces of the magnetic pole members 12.

Figure 3:
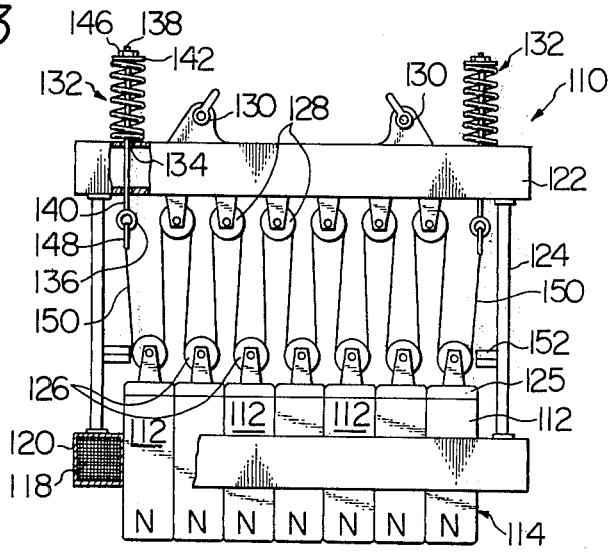
FIG. 3 is a side view, partly in cross section, of the electromagnetic lifting device according to another embodiment of the present invention.
Figure 4:
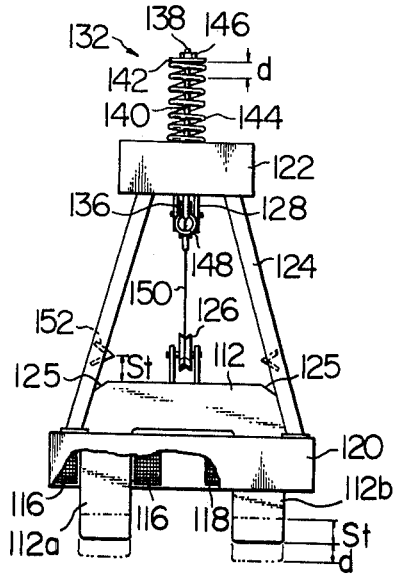
FIG. 4 is a front view of the device of FIG. 3, which is broken partly.
Figure 5:
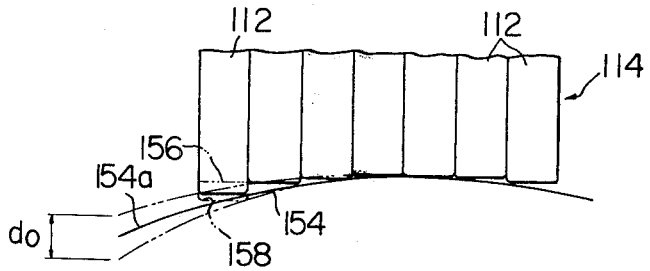
FIG. 5 is a partial side view illustrating the magnetic pole assembly which is lifting a thin sheet metal, which assembly is the essential part of the device according to the present invention.

Referring now to FIGS. 3 to 5, which illustrate another embodiment of the present invention, shown at 110 is an electromagnetic device including a magnetic pole assembly 114 consisting of a plurality of magnetic pole members 112 disposed in side-by-side relation. As in the case of FIG. 1, the respective magnetic pole members 112 are formed with yokes 112a, 112b which oppose to each other, and the yokes being of a U-shape.

Provided in the magnetic pole assembly 114 are coil 116 which surrounds all of the yokes 112*a*, on one side, of the magnetic pole members 112, and coil 118 which surrounds all of the yokes 112*b*, on the other side, of the magnetic pole members 112, and the coils are protected by covers 120, respectively. In addition, the covers 120 are secured and supported on a beam 122 by means of a member 124.

The magnetic pole members 112 have their respective shoulders 125 chamfered, and are provided with pulleys 126 on the tops thereof. On the other hand, the beam 122 is provided therebelow with pulleys 128 of the number less than that of the magnetic pole members 112 by one, and provided thereon with a pair of suspension lugs 130 at the opposite ends thereof and spring assemblies 132. The spring assembly 132 includes: a rod 140 which extends through a hole that vertically pierces through the beam 122, and has a ring 136 at its one end, and which has a threaded end 138 at the other end thereof; a coil spring 144, one end of which is seated on the top surface of the beam 122 and the other end of which is borne against a spring seat member 142. The spring seat member 142 is secured to the rod 140 by means of a nut 146 threaded on the treaded end 138.

A rope 150 is fastened at one end to the rod 140 of the spring assembly 132 by the medium of a ring 148 engaging its ring 136, while the rope 150 is trained around pulleys 126 provided on the magnetic pole members 112 as well as around pulleys 128 provided on the beam 122, with the other end of the rope 150 fastened to the spring assemblies 132, as in the case with the aforesaid one end thereof.

As is apparent from the foregoing, the rope 150 is fastened to the spring assemblies 132 on the beam 122 at the opposite ends thereof, and runs around the pulleys 126, 128 of the magnetic pole members 112 and beam 122, respectively, so that the respective magnetic pole members enable the relative up and down movements. It is preferable to prevent an excessive stroke of lifting of the magnetic pole members 112 at the opposite ends thereof, due to the intermediate magnetic pole members being further lowered from the balanced condition shown, by limiting the extent of the movements of the magnetic pole members located at the opposite ends of the assembly. To this end, there is provided on the members 124 stoppers 152 engaging the chamfered shoulders 125 of the magnetic pole members 112. The engagement of the stoppers with the shoulders 125 maintains all the magnetic pole members 112 on the both sides in a well balanced condition, thus preventing the magnetic pole members from being lifted beyond a range St (FIG. 4) from the position shown, in which the surfaces of the magnetic poles are in the same plane.

The springs 144 of the spring assemblies 132 allow the elastic deformation *d* (FIG. 4). This permits the two magnetic pole members 112 at the opposite ends to be lifted by a distance *d*, without resorting to the movement of the rope 150 which runs around the pulleys 126, 128. This aids in permitting the magnetic pole members to follow a steel product, which members are located on the opposite ends of the assembly, upon the vertical deflection of a cantilever portion of the steel product such as a thin steel sheet, as will be described hereinafter.

Upon lifting of a steel product by means of the lifting device 110, the magnetic pole members 112 are lowered onto the steel product, thereby achieving desired contacts between the members 112 and the surface of the steel product according to the individual up and down movements of the respective magnetic pole members 112 so as to accommodate the configuration of the steel stock, after which the steel stock is attracted to the magnetic pole members due to the current being fed to the coils 116, 118.

FIG. 5 shows the relative lifting positions of the magnetic pole members 112 when a steel sheet 154, which is susceptible to deflection, is lifted, and the intermediate magnetic pole members go upwards relatively while the magnetic pole members on the opposite end of the magnetic pole assembly are lowered relatively. The same results will be obtained when lifting a steel product having a convex surface. The cantilever portion 154*a* of a steel sheet 154 is deflected in the vertical direction within the range of $d_o$(FIG. 5), while the magnetic pole members 112 on the opposite ends move in the range confined between the two point chain lines 156 and 158, thereby preventing magnetic pole members from coming off the steel sheet due to the deflection of the sheet.

Firstly, when the portion 154*a* of the steel sheet 154 is deflected upwards, the magnetic pole members 112 are lifted, until the shoulders 125 of the members 112 abut the stoppers 152, and thereby the magnetic pole plane is moved from the solid line to the chain line 156, coupled with the steel sheet 154. On the other hand, when the portion 154*a* of the steel sheet 154 is deflected downwards, then the magnetic pole plane is moved from the solid line to the chain line 158 within the range of the allowable elastic deformation *d* of the coil springs 144 in the spring assemblies 132 which are subjected to compression-deformation. Thus, the cantilever portion 154*a* having a deflection $d_o$ of the steel sheet 154 follows the movement of the rope 150 as well as the up and down movements of the magnetic pole members, which movements are caused by extension and compression of the coil springs 144, while the magnetic force, which is exerted from the magnetic pole members 112 onto the steel sheet 154, may be maintained without being interrupted due to the deflection of the cantilever portion 154*a* of the steel sheet.

Figure 6:
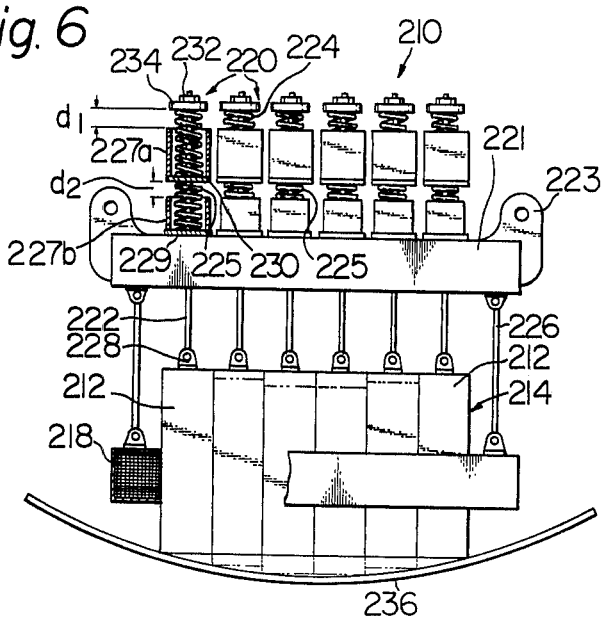
FIG. 6 is a side view, partly in cross section, of the electromagnetic lifting device according to a still another embodiment of the present invention.
Figure 7:
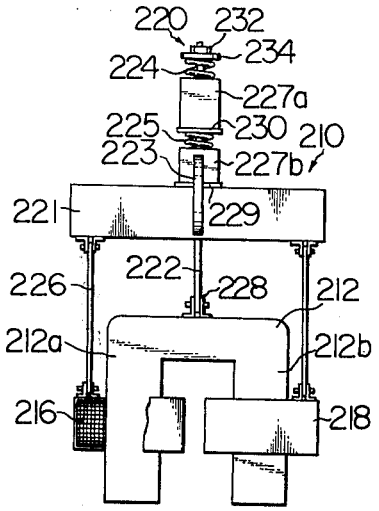
FIG. 7 is a front view, partly broken, of the device of FIG. 6.

Referring now to FIGS. 6, 7 which show still another embodiment of the invention, the electromagnetic lifting means 210 includes a magnetic pole assembly 214 consisting of a plurality of magnetic pole members 212. The respective magnetic pole members 212 are of a U-shape and are formed with yokes 212*a* and 212*b*. Provided in the magnetic pole assembly 214 are magnet-exciting electric coils 216 which surround all of the yokes 212*a* on one side, and electric coils 218 which surround all of the yokes 212*b* on the other side of the magnetic pole members.

Respective magnetic pole members 212 are coupled to the beam 221 through the medium of the spring assembly 220. The beam 221 is provided with a pair of suspension lugs 223 and supports the coils 216, 218 through the medium of the suspension member 226.

The spring assembly 220 includes: a rod 222, one end of which is pivotally connected to a bracket 228 provided on top of the magnetic pole member 212 and which extends through the beam upwards; coil springs 224, 225 surrounding the rod and located in the upper and lower portions of the rod, respectively; and collars 227*a*, 227*b* adapted to limit the delfections of the springs 224, 225. The respective coil springs are confined between a lower spring seat member 229 provided on the beam 221 and an intermediate spring seat 230 which is spaced a distance from the member 229, and between the intermediate spring seat member 230 and an upper spring seat member 234, respectively. On the other hand, collars 227*a*, 227*b* surround the coil springs 224, 225 so as to limit to $d_1$, $d_2$ the elastic deformations of springs under compression. The provision of the two collars 227*a*, 227*b* limits the elastic deformation of two coil springs to $d_1 + d_2$ in total, when the magnetic pole members attract a steel product.

With the spring assembly 220 shown, there are provided two coil springs 224, 225 located on the upper and lower sides of the intermediate spring seat member 230 and surrounding around the rod 222. However, the number of the coil springs may be increased as required, and alternatively a single coil spring may be provided. The sizes of the coil springs 224, 225 may be identical or different from each other.

As shown in FIG. 6, in case a steel sheet which has been formed to a concave shape is to be lifted, the lifting device 210 is located above the curved surface of the steel sheet 236, with the coils 216, 218 rendered non-conductive. In this respect, the magnetic pole members at the opposite ends of the assembly contact the surface of the steel sheet, while four intermediate magnetic pole members which have not contacted the surface of the steel sheet 236 will be lowered by compressing one or both of the coil springs 224, 225, as shown by the two-point chain line in FIG. 6, until the magnetic pole surfaces of the intermediate magnetic pole members contact the surface of the steel sheet 236. Thereafter, a current is fed to the coils 216, 218 so as to exert a magnetic force on the steel sheet 236, and the magnetic pole members are lifted or lowered by means of suspension lugs 223 provided on the beam 221.

As is apparent from the foregoing description of the electromagnetic lifting device according to the present invention, the magnetic pole surfaces contact the curved or irregular surface of a ferromagnetic material, at many points or in a total wide area, so that a magnetic force will be exerted on the steel sheet effectively, when lifting or lowering same. In addition, the magnetic pole surfaces may follow or accommodate the vibration or deflection of the cantilever portion of a steel stock, so that there may be achieved safe and positive lifting operation of steel stocks, without using a considerably large size electromagnet, yet with an increase in the allowable lifting load.

What is claimed is:

1. An electromagnetic lifting device for handling ferromagnetic material comprising:

a magnetic pole assembly consisting of a plurality of magnetic pole members disposed in side-by-side relation to each other, said magnetic pole members each having a pair of opposing yokes;

a first magnet-exciting coil surrounding said yokes on one side and a second-magnet exciting coil surrounding said yokes on the other side, of said magnetic pole members, said first and second coils being incorporated in said magnetic pole assembly; and means for connecting said magnetic pole members in a relatively movable relation to each other.

2. An electromagnetic lifting device as set forth in claim 1, wherein each of said magnetic pole members is made of a ferromagnetic metal and of a U-shape, the yokes of said magnetic pole members are provided with magnetic pole surfaces at their ends, respectively.

3. An electromagnetic lifting device as set forth in claim 1, wherein each of said magnet-exciting coils is secured to one of said yokes of said magnetic pole members.

4. An electromagnetic lifting device as set forth in claim 1, wherein said connecting means includes: a plurality of pulleys provided in the top portions or respective magnetic pole members; a beam provided with a plurality of pulleys which are located above said firstly referred pulleys; and a rope which is trained around the said firstly referred pulleys and secondly referred pulleys, and fastened to said beam at the opposite ends thereof.

5. An electromagnetic lifting device as set forth in claim 1, wherein said connecting means includes a first set of pulleys provided in respective magnetic pole members and a beam provided with a second set of pulleys located above said first set of pulleys, spring assemblies provided on said beam, and a rope which is trained in turn around said pulleys and fastened to said spring assemblies at the opposite ends of said beam.

6. An electromagnetic lifting device as set forth in claim 5, wherein each said spring assembly includes a rod piercing through said beam and formed with a rope attaching portion at one end thereof and a threaded portion at the other end; and a coil spring confined between the top portion of said beam and a spring set member secured on the end of said rod.

7. An electromagnetic lifting device as set forth in claim 5, wherein said beam supports said magnet-exciting coils coupled to said beam by means of a plurality of connecting members, said connecting members being provided with stoppers which are engageable with the outermost magnetic pole members, respectively, so as to limit the extent of the strokes of said outermost magnetic pole members.

8. An electromagnetic lifting device as set forth in claim 1, wherein said connecting means consists of a beam and a plurality of spring assemblies which secure said magnetic pole members to said beam, respectively.

9. An electromagnetic lifting device as set forth in claim 8, wherein each of said magnet-exciting coils is supported by said beam.

10. An electromagnetic lifting device as set forth in claim 8, wherein each of said spring assemblies consists of: a rod secured to the top portion of each of said magnetic pole members and piercing through said beam upwards; an upper spring seat and a lower spring seat both of which are secured to said rod, said upper spring seat being located above said lower spring seat; at least one coil spring confined between said upper and lower spring seats; and a member for limiting the extent of elastic deformation of said coil spring under compression.

11. An electromagnetic lifting device as set forth in claim 8, wherein each of said spring assemblies consists of: a rod secured to the top portion of each of said magnetic pole members and piercing through said beam upwards; an upper spring seat and a lower spring seat which are secured to said rod, said upper spring seat being located above said lower spring seat; a plurality of coil springs confined between said upper and lower spring seats and having different spring constants; and a plurality of members limiting the extents of elastic deformations of said coil springs under compression.

* * * * *